US005864746A

United States Patent [19]

Chang

[11] Patent Number: 5,864,746

[45] Date of Patent: Jan. 26, 1999

[54] GRINDER FOR FINGERNAIL COSMETOLOGY

[76] Inventor: Lin Wu Chang, Rm. 5D-14, 5th Fl. Hsinyi Road, Sec. 5, Taipei, Taiwan

[21] Appl. No.: 15,244

[22] Filed: Jan. 29, 1998

[51] Int. Cl.[6] ..... B24B 23/00

[52] U.S. Cl. ..... 451/296; 451/297; 451/299; 451/311; 451/355

[58] Field of Search ..... 451/296, 297, 451/299, 311, 355, 513

[56] References Cited

U.S. PATENT DOCUMENTS

| | | | |
|---|---|---|---|
| 2,976,652 | 3/1961 | Bedortha et al. | 451/355 |
| 3,566,549 | 3/1971 | Britton | 451/355 |
| 3,713,255 | 1/1973 | Welsch | 451/355 |
| 4,411,106 | 10/1983 | Fleckenstein et al. | 451/355 |
| 4,551,951 | 11/1985 | Nace | 451/355 |
| 4,578,906 | 4/1986 | Appleton | 451/355 |
| 4,858,390 | 8/1989 | Kenig | 451/355 |
| 5,031,362 | 7/1991 | Reiling et al. | 451/355 |
| 5,643,062 | 7/1997 | Joseph et al. | 451/355 |

*Primary Examiner*—Eileen P. Morgan
*Attorney, Agent, or Firm*—Bacon & Thomas, PLLC

[57] ABSTRACT

The surface of a fingernail is efficiently and uniformly ground by a grinder having an endless grinding belt that is adjustably supported between a rotating wheel mounted on a follower axle and a connecting portion of a driving axle carried by a connecting seat. The driving axle is rotated by a round axle disposed within a hollow pipe and rotated by a driving unit.

1 Claim, 6 Drawing Sheets

GRINDER FOR FINGERNAIL COSMETOLOGY

BACKGROUND OF THE INVENTION

1. Field of the Invention

The present invention is related to improvement of the structure of a grinder for fingernail cosmetology, the grinder is comprised mainly of a pipe, a rotating axle, a driving axle, a connecting seat, a follower axle, an elastic element, an adjusting rod, a grinding belt made from a circling sand cloth and a driving unit. By combination of the members, the nails can be ground and polished in a larger area by the grinder. Perfectly smooth and bright nails can be realized and the operation of the grinder is faster and more reliable, thereby saving time, work and power.

2. Description of the Prior Art

A conventional device for nail cosmetology is used mainly for trimming women nails, and is an auxiliary tool for making up the shape and apparent beauty of the nails. It is the nature of people and especially of women to love beauty, and women think highly of all parts of their body from their hair to their toes. The present invention mainly studies the cosmetology on women nails (including toe-nails). In making up their nails, women use nail-nippers to give shape to the top edges of their nails, and they also use nail-files to grind the coarse and unsmooth top edges, so that the top edges can be more smooth and good looking. After that, files of various softness are used to grind and polish the uneven nail surfaces. In this way, smooth and bright nails can be obtained.

The aforesaid nail (and toe-nail) cosmetology is a cosmetology pointing at the apparent natural beauty of nails. The neat and smooth nail surfaces is suitable for applying thereon nail polish or nail oil to increase brightness and beauty. A trimmed nail applied with nail polish can make the nail polish neater. Less evident undulation can be removed by a fine and soft sponge file and polish will result in a bright and beautiful appearence. Modern nail cosmetology takes advantage of sticky fake nails to make various strange appearances and the junctions between the fake nails and the genuine nails, and the fake nails with large area of surfaces, can also be patched with filler, and are processed in detail with a file to beautify the nails.

The abovementioned nail cosmetology is a basic principle for processing, and is suitable for individuals to maintain beauty of nails. However, more professionally, the cosmetologists face a lot of customers every day and hold various nail-files to work carefully, and this imposes an extremely large burden to their hands as well as mind, and this is an extremely uneconomic or inefficient practice. In view of this, a grinding and carving pen for nails has been developed as shown in FIG. 1, wherein, a pipe 10 receives a rotating axle 20 and is contacted with a plurality of bearings 21, the rotating axle "B" can be integrately rotated in and with the pipe 10; the rotating axle 20 is provided on the front end thereof with a screw thread 23 and a hole 24; an elastic chuck 25 is inserted in the hole 24, and is slipped over with a sleeve 26 having an inner thread therein, a grinding accessory 27 is turned is inserted in the elastic chuck 25, the sleeve 26 to connect the inner thread with the external screw thread 23, the grinding accessory 27 can be firmly clamped on the rotating axle 20; the tailing end of the rotating axle 20 is connected to a driving unit 28, when the driving unit 28 is activated, it drives the rotating axle 20 and in turn the grinding accessory 27 to grind the nail.

The grinding accessory 27 is a multipurpose member provided for cosmetology, such as a coarse or fine sand wheel, or various shaped grinding and filing drills; by exchange among a plurality of grinding accessories with different functions, operation of a grinding and carving pen in cosmetology can be easier, faster and more efficient, and the nails can have a more beautiful and brighter appearence than nails from the hand working cosmetology. It has higher efficiency in filing and polishing, so that the work of providing fake nails can be more reliable and convenient.

SUMMARY OF THE INVENTION

In view that in the grinding accessories of the abovementioned grinder, and based on the experience of years of the inventor of the present invention in designing, developing and selling of similar products, when a sand wheel is used in grinding and polishing nails, the area that the sand wheel contacts the surface of a nail is more than a point, continuous grinding and polishing a nail with the sand wheel in moving can make the whole nail smooth, however, when looking in detail, the surface of the nail includes multiple small planes or even is a fake smooth surface having a plurality of small concaved surfaces connecting mutually, and just can not get the result of a wholly smooth surface. The inventor of the present invention provides an improvement on a grinding carving pen for cosmetology after repeated study, improving as well as innovation and multiple tests. In the present invention, a grinding unit with a circling sand cloth is comprised of a driving axle, a connecting seat, a follower axle, an elastic element, an adjusting rod, a grinding belt made from a circling sand cloth. By combination of the grinding unit having the circling sand cloth with a pipe and a rotating axle, and by being driven of the grinding unit having the circling sand cloth by a driving unit, a nail can be cosmetologically ground and polished. The soft elastic grinding belt of the grinding unit having the circling sand cloth can contact the nail in a larger area, therefore, only a smaller adjustment on the angle formed by it with the surface of the nail in grinding, almost the whole surface of the nail can be ground or polished; the rest surface of the nail not ground only needs to be ground and polished with the grinding belt made from the circling sand cloth wrapping around the driving axle and the follower axle in order to be completely processed. In this way, the nail cosmetology can be more perfect, and a smooth and bright nail surface can be obtained; and by the capability of processing in a larger area, nail cosmetology can be done faster and more reliable.

The primary object of the present invention is to provide a grinding belt made from a circling sand cloth to connect it with a pipe of a grinding carving pen, a rotating axle and a driving unit, when it drives the grinding belt made from the circling sand cloth to rotate on the surface of a nail for grinding and polishing, by the elasticity provided by the grinding belt, it can get a larger contact area with the nail surface in grinding, only a smaller adjustment on the angle formed by it with the surface of the nail in grinding, almost the whole surface of the nail can be ground, such a contact processing in the large area adds to the grinding in small areas by the sand cloth of the grinding belt on the driving axle to make a completely smooth and bright surface on the nail; the uneven fake smooth surface resulted by a conventional sand wheel as stated above can be avoided.

Another object of the present invention is to take advantage of the feature of capability of processing a large area by using a grinding carving pen having a circling sand cloth in nail cosmetology, processing of the nail can be faster and more reliable, the high efficiency meets the requirement of economic effect.

Another object of the present invention is to take advantage of the feature of capability of processing a large area by using a grinding carving pen having a circling sand cloth in nail cosmetology, the force that the the grinding unit having the circling sand cloth exerts on the surface of the nail can be distributed to the large area without overdamage to the surface of the nail, so that the problem of damage of the nail or even of intruding of germs to induce dicease can be avoided.

The present invention will be apparent after reading the detailed description of the preferred embodiment thereof in reference to the accompanying drawings.

DETAILED DESCRIPTION OF THE PREFERRED EMBODIMENT

Figure 1:
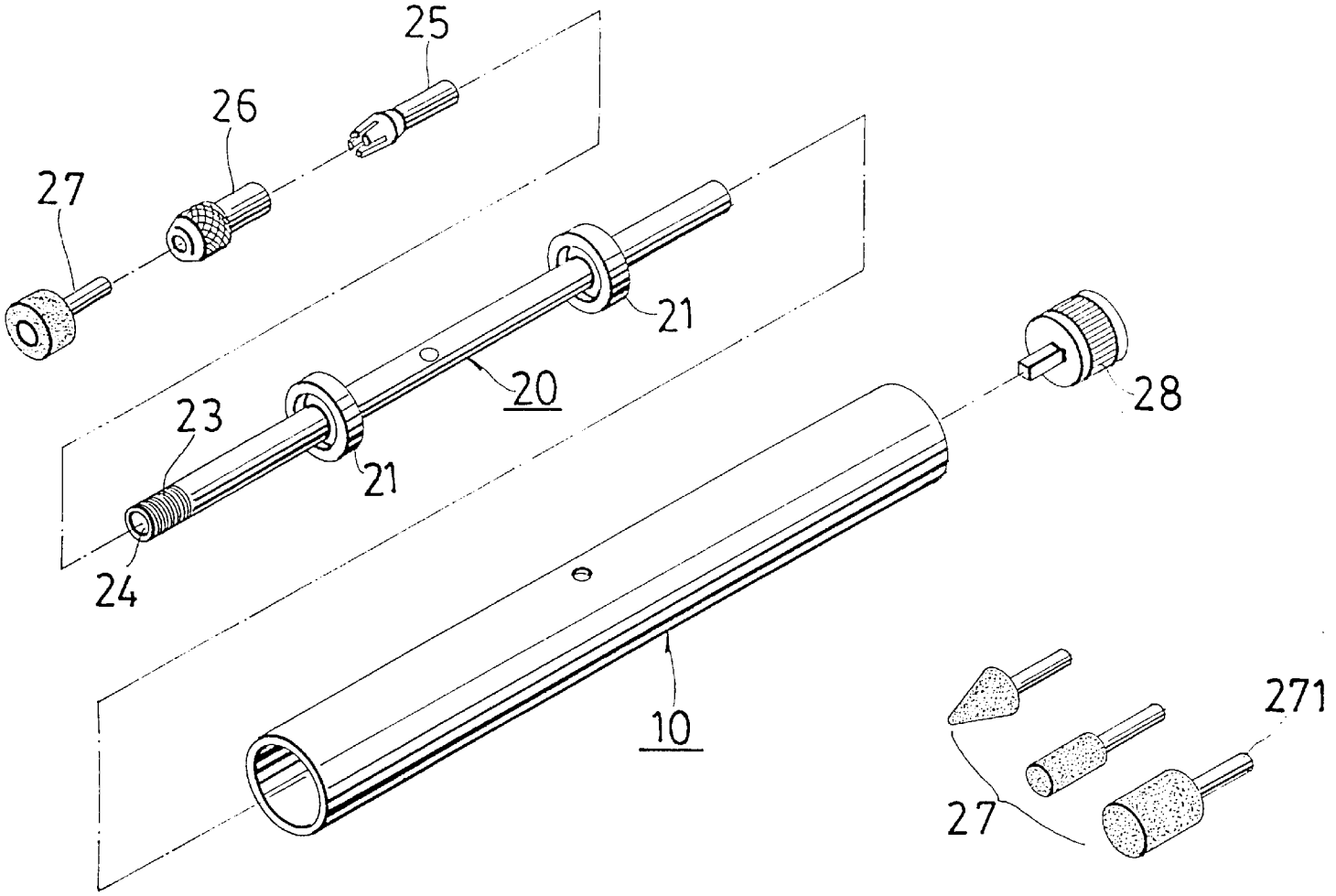
Fig. 1 PRIOR ART
FIG. 1 is an analytic perspective view of a conventional grinder.
Figure 2:
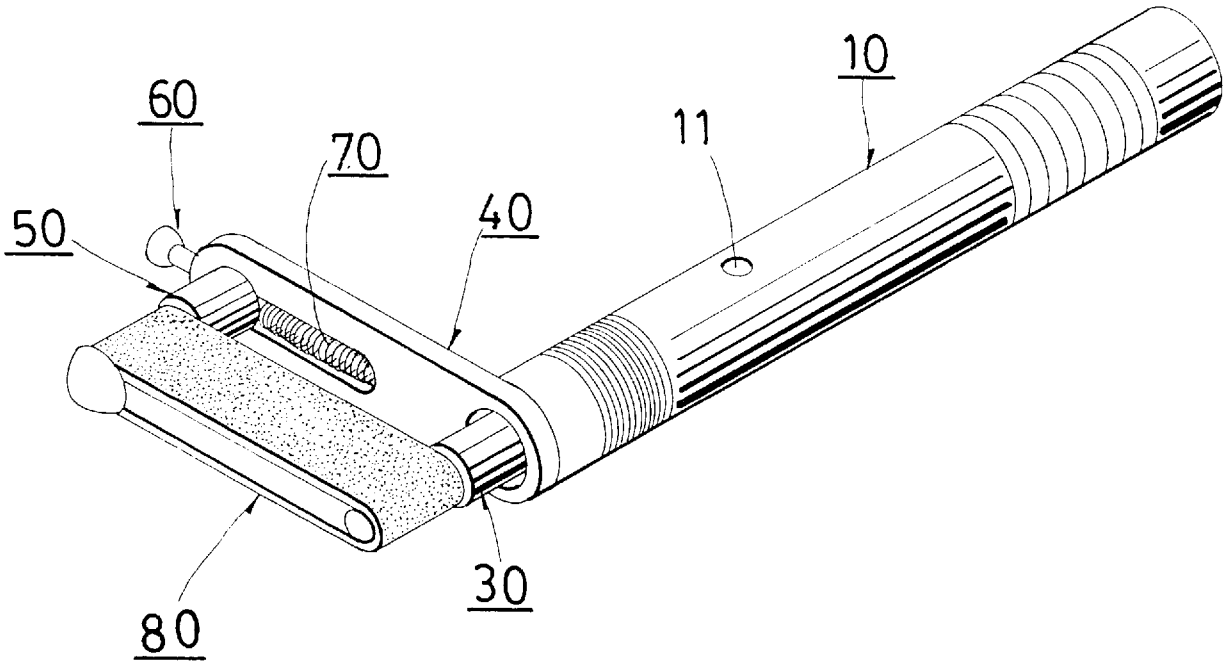
FIG. 2 is a perspective view of the present invention.
Figure 3:
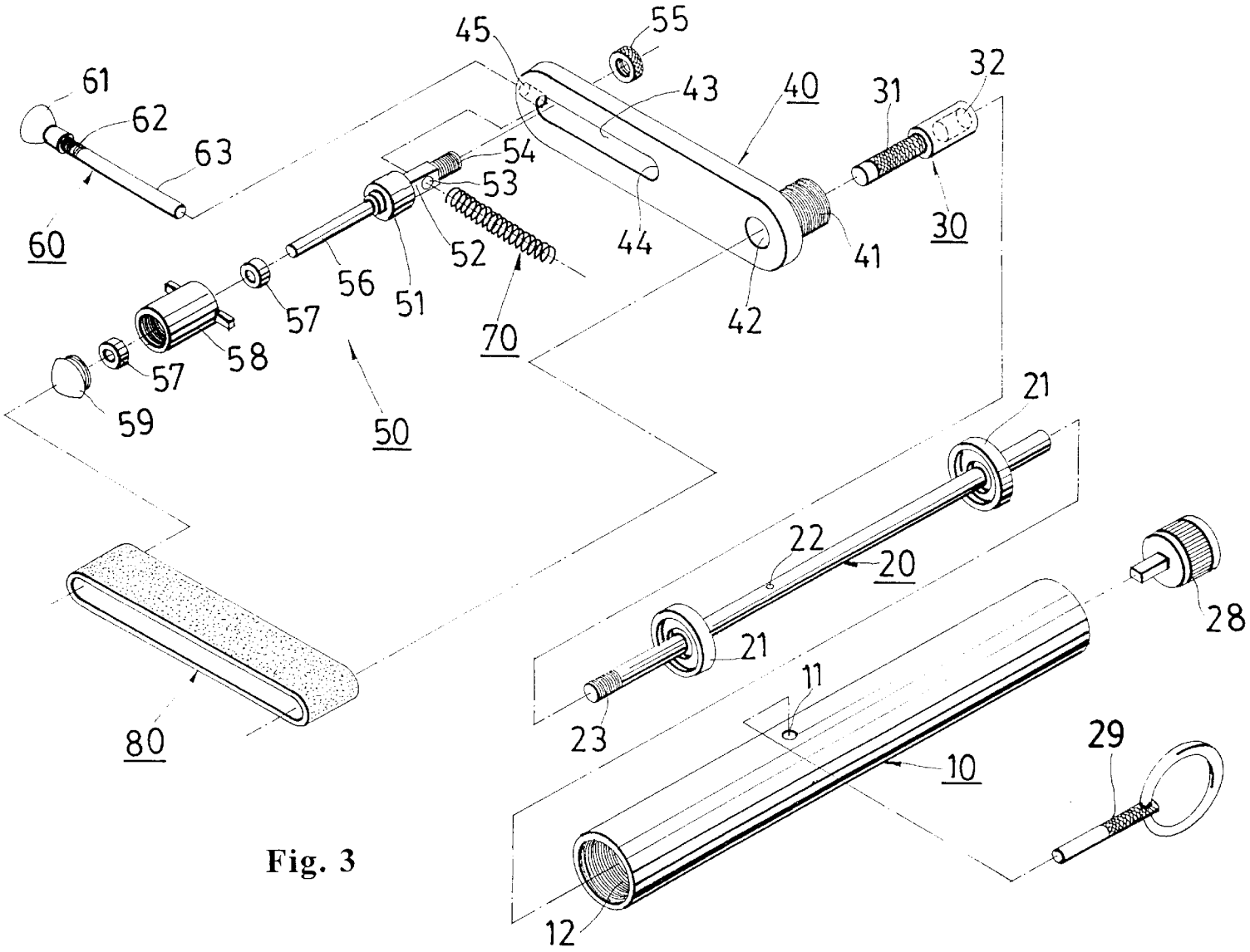
FIG. 3 is an analytic perspective view of the present invention.

Referring to FIG. 2 and 3, the present invention is comprised mainly of a pipe 10, a rotating axle 20, a driving axle 30, a connecting seat 40, a follower axle 50, an adjusting rod 60, an elastic element 70 and a grinding belt 80 made from a circling sand cloth. Wherein, the pipe 10 is a round pipe provided with an endless hole 11 on the shank and with an inner screw thread 12 on the mouth thereof, the rotating axle 20 is a round axle being received in the pipe 10 and is contacted with a plurality of bearings 21. The rotating axle 20 is rotatable in the pipe 10 and is provided with a pin hole 22 corresponding to the hole 11, and further is provided on the front end thereof with an external screw thread 23. The tailing end thereof is pivotally connected with a driving unit 28. The driving axle 30 is provided on the front end thereof with a connecting portion 31 including a knurled portion and a tailing end having a smooth surface, and is provided on the other end thereof with an inner screw thread 32 for connecting with the external screw thread 23. An insertion pin 29 (FIG. 3) is inserted in the hole 11 and the pin hole 22 to stop the rotating axle 20 in the pipe 10, and this is beneficial to provide a screw connection of the driving axle 30 to the front end of the rotating axle 20. The connecting seat 40 is in the shape of an elongate plate, and is provided on one end thereof with a connecting pipe 42 having an external screw thread 41 for connecting with the inner screw thread 12 on the pipe 10. The hollow connecting pipe 42 allows insertion of the driving axle 30 which keeps an interspace therewith and therefore can rotate therein. The connecting seat 40 is excavated to form a guide groove 43 which is provided on one end thereof near the hollow connecting pipe 42 with a hole 44 and on the other end thereof with a through hole 45 extending through the connecting seat 40. The follower axle 50 is provided with a cylindrical securing member 51 which is provided on the lower end thereof with a guide block 52 and a screw column 54 with a screw hole 53. The guide block 52 is placed in the guide groove 43 and is slidable in the latter for preventing the securing member 51 from rotating in the guide groove 43. The screw column 54 is extended out of the guide groove 43, and a nut 55 connects and limits the securing member 51 to the connecting seat 40, the screw hole 53 is aligned with the hole 44 and the through hole 45 axially, the securing member 51 is provided with a central axle 56 being connected with a central bearing 57 of a rotating wheel 58 which can rotate about the central axle 56, and the rotating wheel 58 is threadedly connected with a guide knob 59. The elastic element 70 is engaged in the hole 44 with one end thereof, and the central axis thereof is aligned with the axis of the through hole 45 and the screw hole 53. The adjusting rod 60 is provided on one end thereof with a rotating knob 61 and is provided with a guide axle 63 of which one end is provided with a screw thread 62, the guide axle 63 of the adjusting rod 60 is extended into the through hole 45, the screw hole 53 and the elastic element 70, the strew thread 62 is threadedly connected with the screw hole 53 in order to connect the follower axle 50. When the nut 55 is screwed off, the rotating knob 61 of the adjusting rod 60 can slide in the guide groove 43 together with the follower axle 50; the grinding belt 80 made from a circling sand cloth wraps around the connecting portion 31 and the rotating wheel 58 and is kept in position by the elastic pressure of the elastic element 70 compressing the follower axle 50, then the nut 55 is screwed tight for securing.

Figure 5:
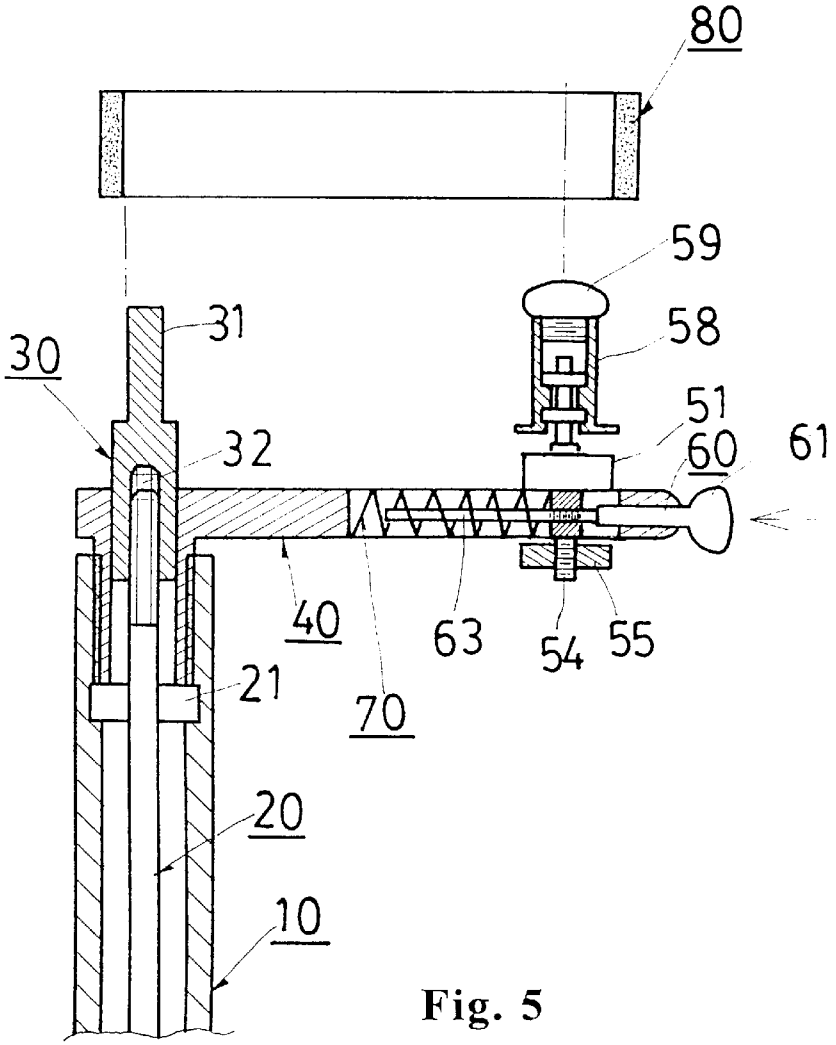
FIG. 5 is a schematic view showing removing and mounting of the grinding belt made from a circling sand cloth of the present invention.
Figure 4:
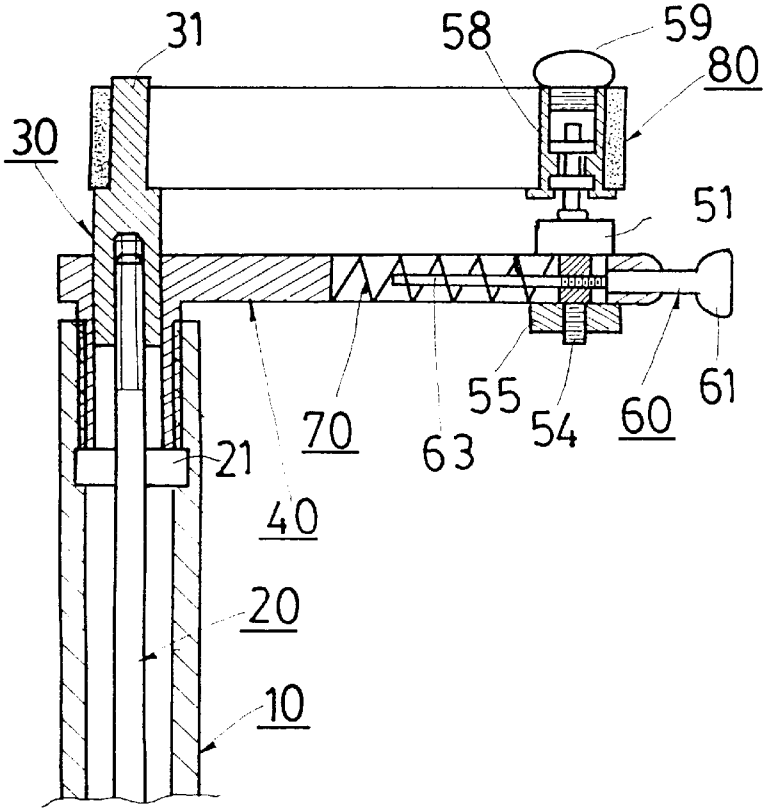
FIG. 4 is a structural sectional view of the present invention.
Figure 6:
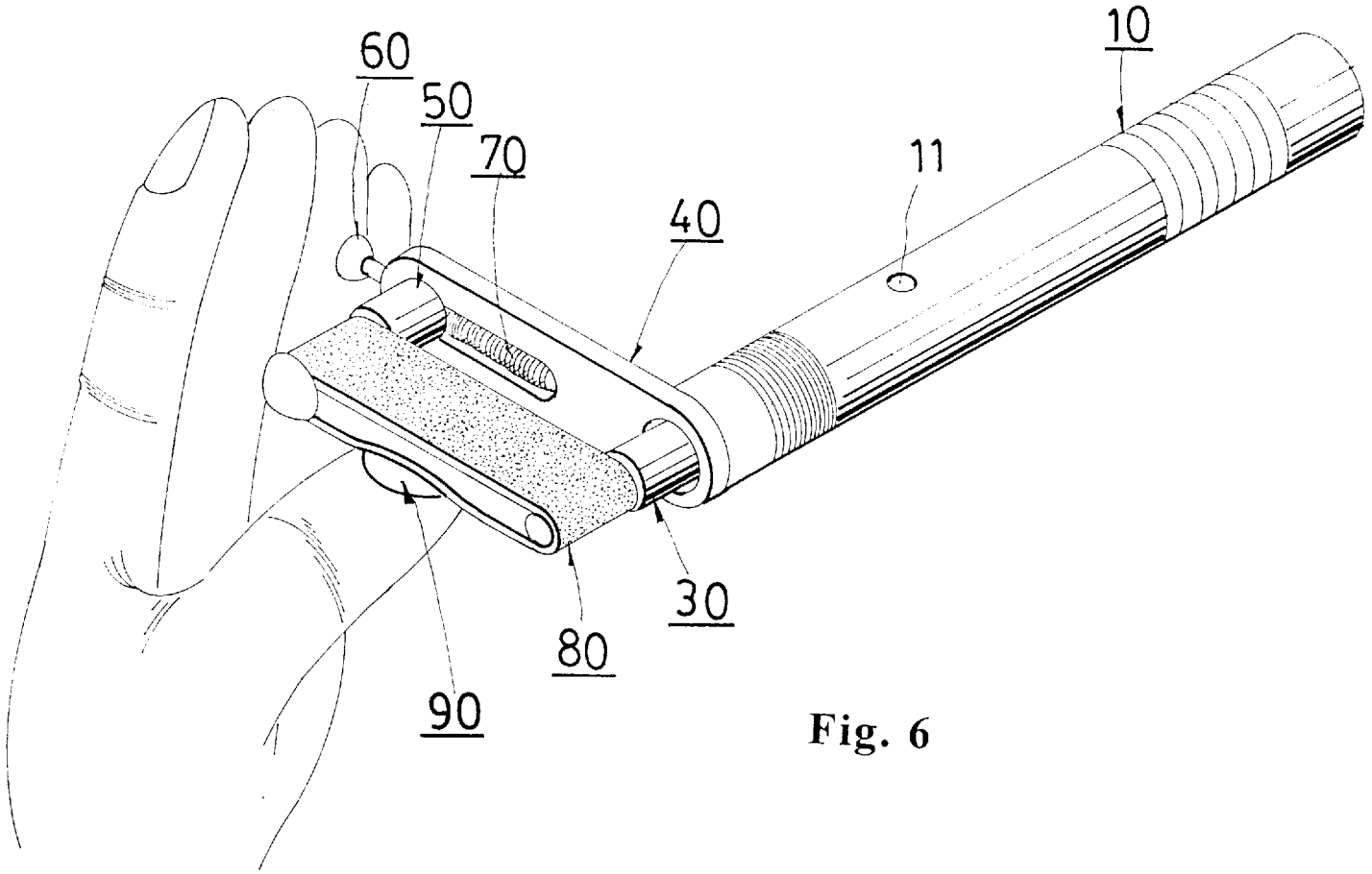
FIG. 6 shows an embodiment of the present invention.
Figure 7:
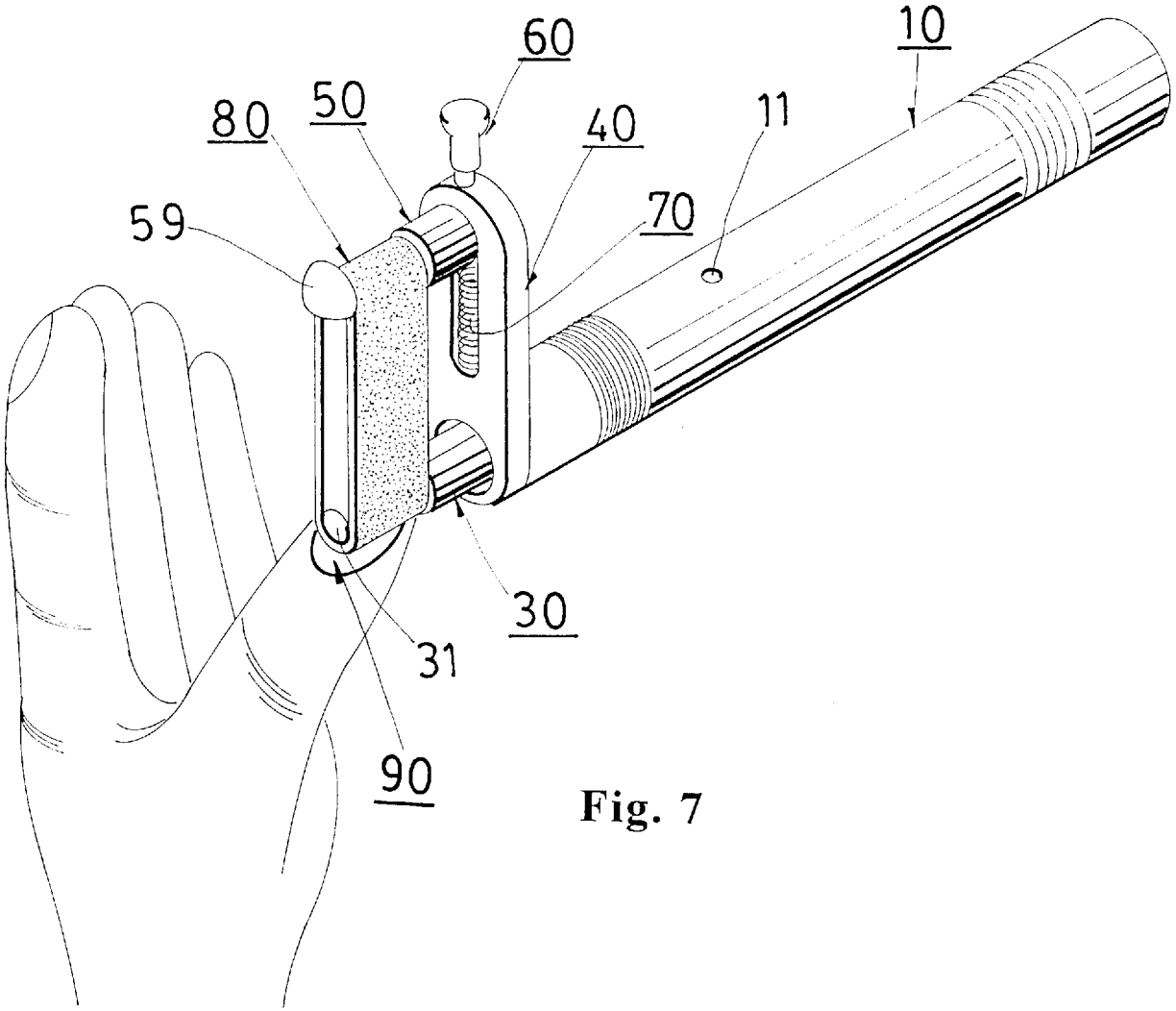
FIG. 7 shows another embodiment of the present invention.

When the driving unit 28 is in working, it rotates the rotating axle 20 and in turn the driving axle 30 and the grinding belt 80 to rotate the rotating wheel 58; the grinding belt 80 revolves between the driving axle 30 and the rotating wheel 58, and is restrained by a head portion of the driving axle 30, a protruding bar on the rotating wheel 58 and the rotating knob 61, so that the grinding belt will not deviate nor fly away; in this way, when in doing nail cosmetology, a plurality of grinding belts 80 with different specifications can be used. As shown in FIG. 5, by the elastic flexibility of a grinding belt 80 between the driving axle 30 and the rotating wheel 58, the grinding belt 80 contacts a large area on the surface 90 of a nail, the pressure exerted on the surface 90 of the nail can be distributed uniformly on the large area, with only a small adjustment by displacement, almost the whole surface of the nail can be ground or polished, such a contact processing in the large area renders the surface 90 of the nail not to have those fake smooth surfaces having a lot of small planes resulted by a conventional grinder, in fact, a wholly smooth surface can be created, such processing is fast and reliable, by the feature of capability of processing a large area, the force exerted can be distributed to the large area without overdamage to the surface of the nail, so that the problem of damage of the nail or even of intruding of germs to induce dicease can be avoided. The FIG. 6, the rim of the surface 90 of a nail can be dealt with by the grinding belt 80 wrapping around the connecting portion 3 of which the tailing end is a smooth surface, so that the surface 90 of the nail and the skin contacted with the grinding belt 80 is not damaged, and thus cosmetology of the surface 90 of the nail is well completed.

In conclusion, the present invention provides a grinding and carving pen which has a grinding unit having the circling sand cloth; by the feature of the capability of processing a large area, cosmetology of the surface 90 of the nail can be completed very fast; when in compression during grinding, the force exerted can be distributed to the large area without overdamage to the surface of the nail, this is surely a safe device; therefore, the present invention has the feature of safe, fast and reliable operation which is therefore time, work and power saving and is economical and industry valuable.

Having thus described my invention, what I claim as new and desire to be secured by Letters Patent of the United States is:

1. A grinder for fingernail cosmetology comprising:

a) a round hollow pipe including a shank and a mouth, a hole formed in the shank and an inner screw thread provided in the mouth;

b) a round axle having a plurality of bearings, the round axle being rotatably received within the hollow pipe, the round axle including a hole formed therein corresponding to the shank hole of the hollow pipe, a front end having an external screw thread, a rear end, and a driving unit connected to the rear end;

c) a driving axle having a front end and a rear end, a connecting portion at the front end and an inner screw thread at the rear end engaged with the external screw thread of the round axle;

d) an elongate connecting seat having a first end and a second end, a threaded hollow connecting pipe at the first end, the connecting pipe engaged with the inner screw thread of the hollow pipe, the drive axle being rotatably received within the connecting pipe, a guide groove formed in the connecting seat, the guide groove including one end provided with a first hole positioned adjacent the connecting pipe and another end provided with a second hole extending through the connecting seat;

e) a follower axle including a cylindrical securing member, a guide block having a screw hole formed therethrough and a screw column, the guide block being slidably disposed in the guide groove and preventing rotation of the securing member, the screw column extending outwardly of the guide groove, a nut engaged on the screw column for securing same to the connecting seat, the screw hole in the guide block being aligned with the second hole of the guide groove, the securing member further including a central axle and a wheel rotatably mounted on the central axle;

f) an elongate elastic element including a first end engaged in the first hole of the guide groove and a central axis aligned with both the second hole of the guide groove and the screw hole of the guide block;

g) an adjusting rod having a first end provided with a rotatable knob and a second end disposed through the second hole of the guide groove, the screw hole of the guide block and central axis of the elastic element, the adjusting rod being threadedly engaged with the screw hole of the guide block for slidably moving the follower axle along the guide groove when the nut engaged on the screw column of the follower axle is loosened; and h) an endless grinding belt wrapped around the connecting portion of the driving axle and the wheel of the follower axle for rotation thereby when the round axle is rotated by the driving unit.

* * * * *